US009562466B2

(12) United States Patent
Day

(10) Patent No.: US 9,562,466 B2
(45) Date of Patent: Feb. 7, 2017

(54) HEAT EXCHANGER FOR EXCHANGING HEAT BETWEEN A FIRST FLUID AND A SECOND FLUID, BOTH HAVING U-CIRCULATION

(75) Inventor: Alan Day, Thillois (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 527 days.

(21) Appl. No.: 14/129,370

(22) PCT Filed: Jun. 28, 2012

(86) PCT No.: PCT/EP2012/062584
§ 371 (c)(1),
(2), (4) Date: Mar. 25, 2014

(87) PCT Pub. No.: WO2013/001011
PCT Pub. Date: Jan. 3, 2013

(65) Prior Publication Data

US 2014/0190673 A1 Jul. 10, 2014

(30) Foreign Application Priority Data

Jun. 30, 2011 (FR) ..... 11 02057

(51) Int. Cl.
*F01N 5/02* (2006.01)
*F02B 29/04* (2006.01)
(Continued)

(52) U.S. Cl.
CPC ..... *F02B 29/045* (2013.01); *F28D 7/1661* (2013.01); *F28D 7/1692* (2013.01); *F02B 29/0462* (2013.01); *F28D 2021/0082* (2013.01)

(58) Field of Classification Search
CPC ..... F28D 7/1661; F28D 7/1692; F28D 2021/0082; F02B 29/045; F02B 29/0462
(Continued)

(56) References Cited

U.S. PATENT DOCUMENTS 4,565,177 A * 1/1986 Roettgen ..... F02B 29/0462 123/563
5,152,144 A * 10/1992 Andrie ..... F02B 29/0418 123/549
(Continued)

FOREIGN PATENT DOCUMENTS

DE 10 2010 009 533 B3 6/2011
EP 1 348 924 A2 10/2003
(Continued)

OTHER PUBLICATIONS

International Search Report for Application No. PCT/EP2012/062584 dated Aug. 6, 2012, 5 pages.
(Continued)

*Primary Examiner* — Ljiljana Ciric
(74) *Attorney, Agent, or Firm* — Howard & Howard Attorneys PLLC

(57) ABSTRACT

A heat exchanger exchanges heat between first and second fluids. The heat exchanger includes a heat exchange core which includes first circulation channels of the first fluid and second circulation channels of the second fluid. The heat exchanger includes an inlet collector box for the first fluid and an outlet collector box for the first fluid, into which the ends of said first channels open out. The heat exchanger includes an inlet connection piece for the second fluid and an outlet connection piece for the second fluid. The inlet and outlet collector boxes for the first fluid are separated by a deflector. The heat exchanger includes an intermediate collector box communicating with the first channels to create a U-circulation of the first fluid in said first channels. The heat exchanger includes an intermediate compartment communicating with the second channels for a U-circulation of the second fluid in the second channels.

10 Claims, 2 Drawing Sheets

(51) Int. Cl.
*F28D 7/16* (2006.01)
*F28D 21/00* (2006.01)

(58) Field of Classification Search
USPC ..... 165/51; 138/99
See application file for complete search history.

(56) References Cited

U.S. PATENT DOCUMENTS 6,634,420 B2 * 10/2003 Gokan ..... F02B 29/0462 123/563
6,920,918 B2 7/2005 Knecht et al.
8,225,849 B2 * 7/2012 Hendrix ..... F02B 29/0418 123/568.12
8,794,299 B2 * 8/2014 Barfknecht ..... F28D 7/1692 123/568.12
2002/0144801 A1 * 10/2002 Gokan ..... F02B 29/0462 165/51
2007/0193732 A1 8/2007 Oofune et al.
2008/0073059 A1 * 3/2008 Weel ..... F02B 29/0462 165/51
2008/0202724 A1 * 8/2008 Lorenz ..... F28D 7/0075 165/51
2009/0090486 A1 * 4/2009 Geskes ..... F28D 7/06 165/51
2010/0071871 A1 * 3/2010 Gaensler ..... F28D 7/1653 165/51
2011/0017425 A1 * 1/2011 Bourgoin ..... F02B 29/0418 165/51

FOREIGN PATENT DOCUMENTS

EP 1 903 293 A3 4/2008
FR 2 933 179 A1 1/2010

OTHER PUBLICATIONS

English language abstract and machine-assisted English translation for DE 10 2010 009533 extracted from espacenet.com database on May 21, 2014, 27 pages.
English language abstract for EP 1 348 924 extracted from espacenet.com database on May 21, 2014, 11 pages.
English language abstract and machine-assisted English translation for EP 1 903 293 extracted from espacenet.com database on May 21, 2014, 37 pages.
English language abstract and machine-assisted English translation for FR 2 933 179 extracted from espacenet.com database on May 21, 2014, 74 pages.

* cited by examiner

Fig.3
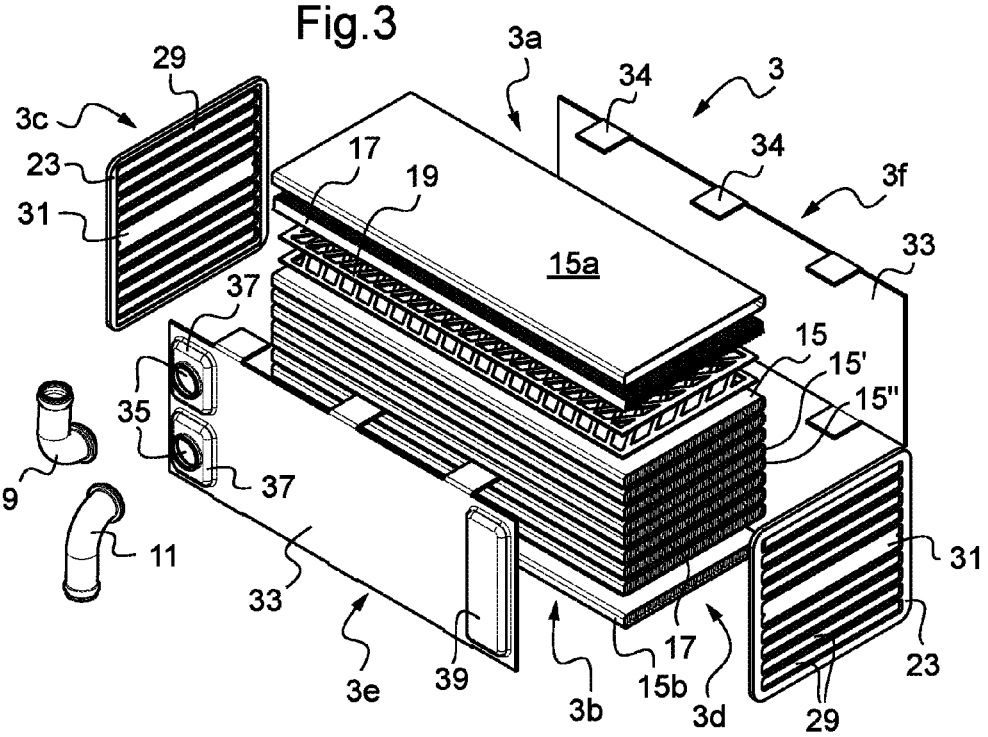
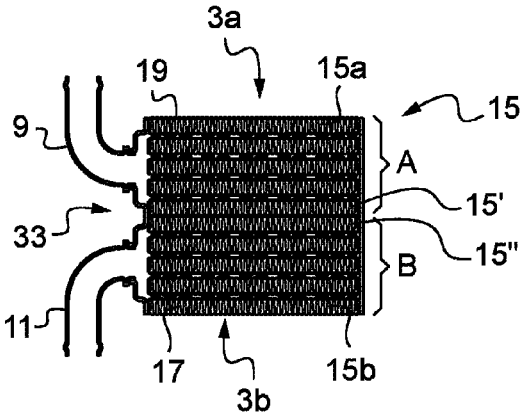
Fig.4
Fig.5
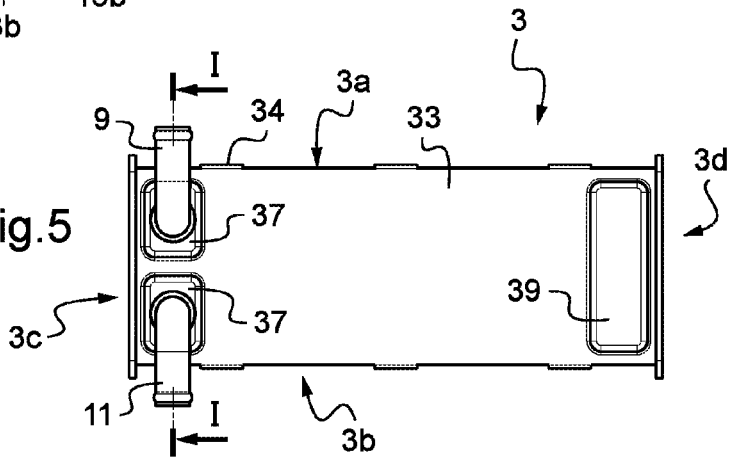

HEAT EXCHANGER FOR EXCHANGING HEAT BETWEEN A FIRST FLUID AND A SECOND FLUID, BOTH HAVING U-CIRCULATION

RELATED APPLICATIONS

This application is the National Stage of International Patent Application No. PCT/EP2012/062584, filed on Jun. 28, 2012, which claims priority to and all the advantages of French Patent Application No. FR 11/02057, filed on Jun. 30, 2011, the content of which is incorporated herein by reference.

The invention relates to a heat exchanger, particularly for a motor vehicle.

A preferred field of application of the invention is that of supercharged engines for motor vehicles which use a heat exchanger referred to as a "charge air cooler" to cool the charge air.

BACKGROUND

In fact, supercharged or turbocompressed heat engines, particularly diesel engines, are charged with pressurized air referred to as "charge air" which comes from a compressor or turbo-compressor. Following its compression, this air is at an excessively high temperature and it is advisable for it to be cooled before entering the engine, in order for the engine to run properly.

Traditionally, a charge air cooler is used for this purpose. The function of this cooler is to cool the charge air by heat exchange with another fluid, such as outdoor air, or also a liquid coolant such as glycol water.

A plurality of structures is known for exchangers or coolers of this kind. In particular, a heat exchanger is known which comprises a heat exchange core mounted in a housing or casing. The heat exchange core comprises, for example, a stack of parallel plates or tubes disposed in parallel to convey the first fluid, whereas a second fluid flows between the tubes. The casing receiving this heat exchange core is generally open at its two ends so that it can be connected to fluid distribution housings: an inlet housing and an outlet housing.

The circulation of the two fluids is important to the heat exchanger performance.

According to a known solution, one of the fluids or the two fluids is circulated through disruptors or turbulators, in order to increase the heat exchange surface between the two fluids.

Moreover, the current trend within the car sector is for the overall dimensions of heat exchangers of this kind to be reduced. However, the reduction in size of the exchanger can reduce the exchange surface between the two fluids and therefore alter the exchanger's performance.

SUMMARY OF THE INVENTION

The object of the invention is to further improve the quality of heat exchanges between the two fluids with the smallest dimensions.

To this end, the object of the invention is a heat exchanger between a first fluid and a second fluid, said exchanger comprising:

- a heat exchange core for a heat exchange between the first and the second fluids, comprising first circulation channels of the first fluid and second circulation channels of the second fluid between said first channels,

- an inlet collector box for the first fluid and an outlet collector box for the first fluid, into which the ends of said first channels open out, and
- an inlet connection piece for the second fluid and an outlet connection piece for the second fluid, characterized in that:

- said inlet and outlet collector boxes for the first fluid are fixed on a first side of said core and are separated by a deflector and said exchanger moreover comprises an intermediate collector box communicating with said first channels to create a U-circulation of the first fluid in said first channels, in that
- said exchanger comprises at least one wall fixed on a second side of said core adjacent to said first side and said inlet and outlet connection pieces for the second fluid are disposed at one end of said wall, being separated one from the other, and said exchanger comprises an intermediate compartment communicating with said second channels for a U-circulation of the second fluid in said second channels, and in that
- said intermediate collector box and said intermediate compartment are disposed on sides of said core perpendicular one to the other.

The U-circulation of the two fluids allows the heat exchange performances to be improved with smaller exchanger dimensions.

Said exchanger may, moreover, comprise one or a plurality of the following characteristics, taken separately or in combination:

- said first and second fluids circulate in countercurrent;
- said exchanger comprises a joint collector box divided by said deflector into two compartments in such a manner as to form said inlet box, on the one hand, and said outlet box, on the other;
- the inlet collector box and the outlet collector box of the first fluid are realized by two different parts;
- the aforementioned core comprises a stack of tubes, of which at least two tubes are joined in such a manner that the lateral surfaces of said joined tubes are located substantially opposite the junction between said connection pieces;
- the intermediate collector box communicating with the assembly of said first channels is disposed on a third side of said core opposite said first side, for U-circulation of the first fluid;
- said intermediate compartment communicating with the assembly of said second channels, for the U-circulation of the second fluid, is disposed on an end of said wall, opposite said connection pieces;
- said core exhibits a general form which is substantially parallelepiped with two end sides, two small lateral sides and two large lateral sides, and in which said first side is a small lateral side and said second side is a large lateral side of said core;
- the aforementioned exchanger is configured for the cooling of charge air of a motor vehicle engine and
- the first fluid is charge air and the second fluid glycol water.

BRIEF DESCRIPTION OF THE DRAWINGS

Other characteristics and advantages of the invention will appear more clearly on reading the following description given by way of an illustrative, non-limiting example, and the attached drawings in which:

FIG. 3 is an exploded perspective view of the heat exchanger core in FIG. 1, FIG. 4 is a side view of the core in FIG. 3 and FIG. 5 is a view according to the section II in FIG. 4.

DETAILED DESCRIPTION

In these figures, elements which are essentially identical are identified using the same reference numbers.

The invention relates to a heat exchanger 1, in particular for cooling the charge air for an engine, such as a diesel engine of a motor vehicle.

According to the embodiment described, this exchanger is what is called an "air-water" exchanger, in other words an exchanger in which the fluids which exchange heat are air and water. In the case of a charge air cooler, the water is preferably water of the so-called "low-temperature" cooling circuit of the aforementioned engine; it is typically glycol water.

Figure 1:
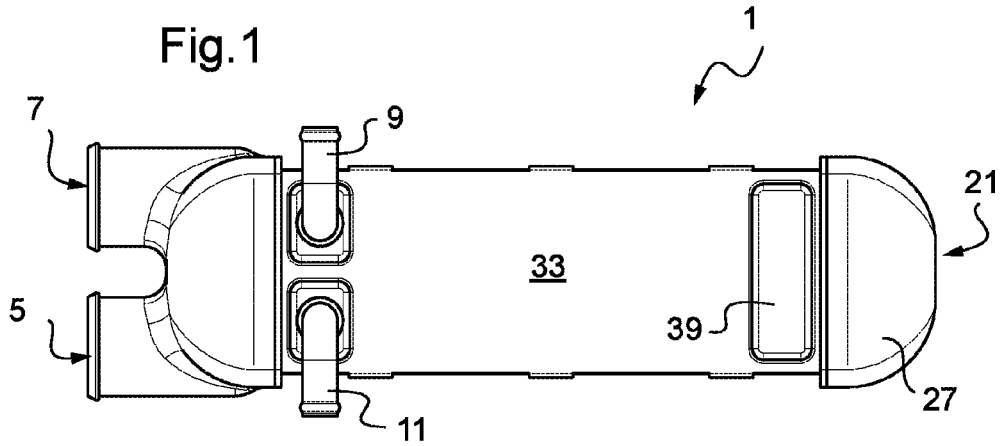
FIG. 1 represents a side view of a heat exchanger.

A heat exchanger 1 of this kind has been depicted in FIG. 1. This exchanger 1, which can be better seen in the exploded perspective view in FIG. 2, exhibits a substantially parallelepiped general form.

The exchanger 1 comprises a core 3 for heat exchange between the first fluid, such as air, and the second fluid, such as water.

To this end, the exchanger comprises a first inlet collector box 5 for the first fluid, air in this case, and a second collector box 7 of outlet air, in order to allow the circulation of air in the core 3, as well as an inlet connection piece 9 of the second fluid, water in this case, and a water outlet connection piece 11, in order to allow the circulation of water in the core 3 by exchanging heat with air.

Figure 2:
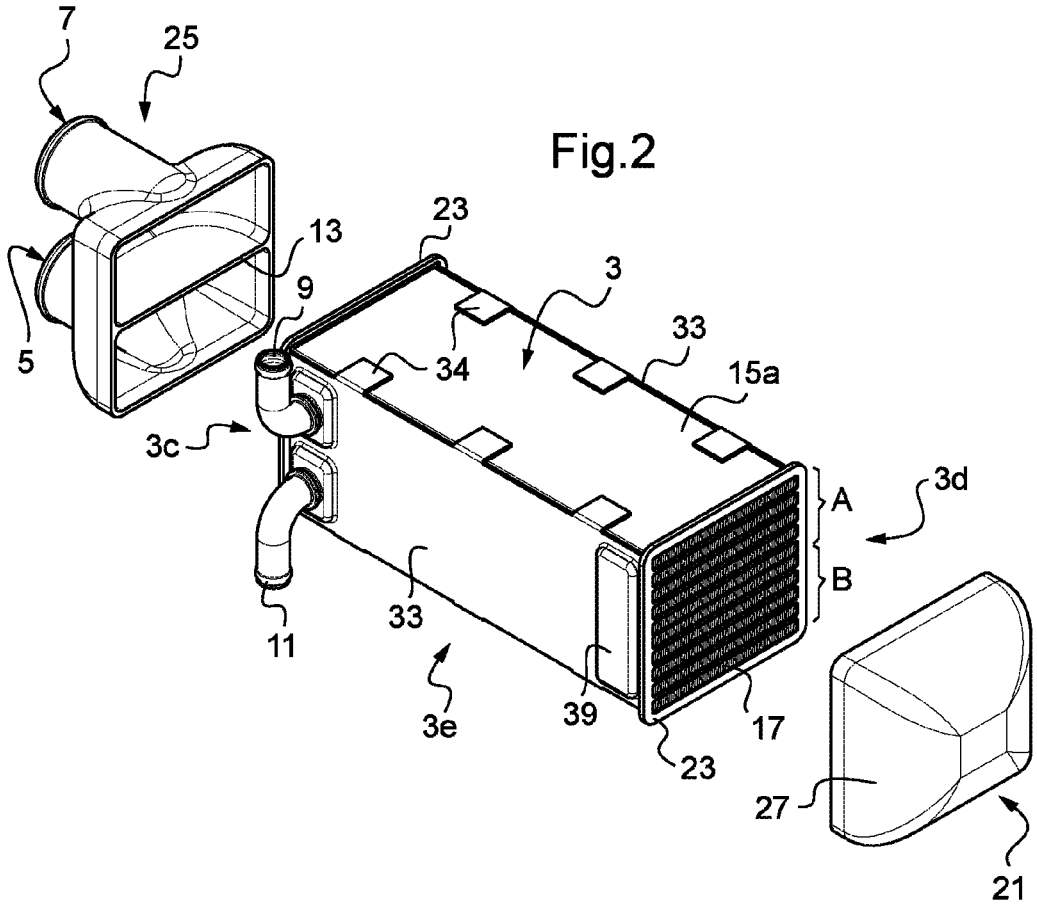
FIG. 2 represents an exploded view of the exchanger in FIG. 1.

As can be seen in FIGS. 2 to 4, the core 3 has a substantially parallelepiped general form. The core 3 therefore has two end sides 3*a*, 3*b*, two small lateral sides 3*c*, 3*d* and two large lateral sides 3*e*, 3*f*. Each large lateral side 3*e*, 3*f* is adjacent to a small lateral side 3*c*, 3*d*.

According to the illustrated embodiment, the air inlet 5 and outlet 7 collector boxes are made on a small lateral side 3*c*, for example, of the core 3. These collector boxes 5, 7 are connected to channels of an air circuit in which the exchanger 1 is mounted.

With reference to FIGS. 1 and 2, the collector boxes 5 and 7 are therefore disposed one above and the other separated by a deflector 13 visible in FIG. 2.

In order to ensure the seal of the exchanger 1, the latter comprises a sealing means (not shown) between the collector boxes and the core 3. Of course the exchanger 1 likewise exhibits a sealing means at the level of the deflector 13 separating the collector boxes 5, 7. By way of example, a seal ring can be provided.

The heat exchange core 3 comprises, for example, a stack of parallel tubes 15, 15*a*, 15*b*, 15', 15" (FIG. 3) for the flow of air. This stack therefore exhibits two end tubes 15*a*, 15*b* in the stacking direction of the tubes 15 and these end tubes 15*a*, 15*b* delimit the end sides 3*a*, 3*b* of the core 3.

These tubes 15, 15*a*, 15*b*, 15', 15' exhibit respectively, for example, a substantially flattened general form.

The tubes 15, 15*a*, 15*b*, 15', 15' define respectively first channels of circulation for air which open out into the inlet 5 and outlet 7 boxes (cf. FIGS. 2 and 3). Air is therefore introduced into the tubes by way of the inlet box 5 and is gathered at the outlet of the tubes by the outlet box 7.

It is possible to provide for disruptor fins 17 with a substantially undulating form, for example, disposed in these tubes 15, 15*a*, 15*b*, 15', 15' to disrupt the air flow and increase the exchange surface, in order to facilitate heat exchanges between the air and water through walls of the tubes 15, 15*a*, 15*b*, 15', 15'.

The fins 17 may be soldered to the tubes 15, 15*a*, 15*b*, 15', 15', for example.

More precisely, in a known manner, these fins 17 may be realized in the form of undulating inserts, formed from metal strip, for example, which is deformed in order to create undulations. Each undulating insert can be disposed in such a manner as to come into contact respectively with the internal walls of a tube through the end regions of the undulations (cf. FIG. 5).

The tubes 15, 15*a*, 15*b* likewise define among themselves second circulation channels for the flow of water.

The second channels are therefore inserted between the tubes 15, 15*a*, 15*b* and the core 3 exhibits alternate stacking of first and second circulation channels.

It is possible to envisage, for example, disruptors 19 of the water flow fitted in these second channels. Disruptors 19 of this kind are represented in a partial and schematic fashion in FIGS. 3 and 5.

These disruptors 19 extend between two tubes, for example over the entire length between two adjacent tubes.

These disruptors 19 exhibit a form creating turbulence in the flow of water passing through them. To this end, the disruptors 19 may be realized in the form of plates exhibiting disruptor designs or also, according to the illustrative example, in the form of two superposed open disruptor plates 19.

Each plate 19 may be soldered to one of the two adjacent tubes defining a second channel.

These disruptor plates 19 form braces between the tubes 15, 15*a*, 15*b* and allow the exchange surface to be increased by disrupting the flow of water. This allows thermal exchanges between the air and water through tube walls.

In this case, the core 3 comprises an alternate stack of tubes and disruptors 19.

Moreover, in this stack, at least two tubes 15' and 15" are joined which are not therefore separated by a second channel or a plate 19. According to the illustrated embodiment, two tubes 15' and 15" are joined.

These two joined tubes 15', 15" are, for example, situated substantially in the middle of the stack. As can be better seen in FIG. 5, these two joined tubes 15', 15" delimit a first portion A or a first half of the core 3, and a second portion or half B.

The first portion A extends from an end tube 15*a* up to a joined tube 15'. The second portion B extends from the second joined tube 15" up to the opposite end tube 15*b*.

According to the embodiment illustrated in FIGS. 2 and 5, on the side of the small lateral side 3*c* of the core 3, the ends of the tubes 15*a*, 15, 15' of the first portion A open out into the air outlet collector box 7. The ends of the tubes 15", 15, 15*b* of the second portion B themselves open out into the inlet air collector box 5. The junction between the tubes 15' and 15" is located substantially opposite the deflector 13 separating the two collector boxes 5 and 7.

This arrangement allows a substantially U-shaped circulation of air in the tubes of the core 3.

Moreover, the exchanger 1 comprises an intermediate collector box 21 (cf. FIGS. 1 and 2) made on the second small lateral side 3*d* opposite the first small lateral side 3*c*.

In order to ensure the seal of the exchanger 1, the latter comprises a seal means (not shown), such as a seal ring, between this intermediate collector box 21 and the core 3.

The ends of the assembly of tubes 15, 15*a*, 15*b*, 15', 15" on the side of the second small lateral side 3*d* open out into this intermediate collector box 21 (cf. FIGS. 2 and 3).

Hence, the air which has circulated in the tubes of the second portion B is collected in this intermediate collector box 21 before circulating in the tubes of the first portion A until it is removed by the outlet box 7.

This intermediate collector box 21 opposite the inlet 5 and outlet 7 collector boxes therefore participates in the U-circulation of air in the core 3.

Moreover, the distribution boxes 5, 7 and 21 are jointly formed by collectors 23 (FIGS. 2 and 3) and complementary associated covers 25 and 27.

According to the illustrated embodiment, the two inlet 5 and outlet 7 boxes are jointly formed from a collector 23 and an associated cover 25.

The cover 25 is formed from a single part and comprises the deflector 13 dividing the cover 25 into two compartments, in such a manner as to form the inlet box 5, on the one hand, and the outlet box 7, on the other.

The collector 23 is disposed at the end of the assembly of tubes, at the level of the small lateral side 3*c*, and allows assembly with the associated cover 25.

The collector 23 is formed from a single part and receives a plurality of tube ends, both from the first portion A and the second portion B of the tube core.

To achieve this, the collector 23 exhibits a plurality of orifices 29 for receiving ends of the tubes 15, 15*a*, 15*b* and displays a larger orifice 31 to receive at the same time the ends of the two joined tubes 15', 15". This larger orifice 31 exhibits twice the dimensions of an orifice 29 of a simple tube end, for example.

It is of course also possible to realize the two collector boxes 5 and 7 in a different manner with two collectors 23 and two associated covers.

In a similar manner, the intermediate box 21 is jointly formed from a collector 23 disposed at the end of the assembly of tubes, at the level of the small lateral side 3*d*, and an associated cover 27.

The collector 23 is identical to the collector 23 of the inlet 5 and outlet 7 boxes in this case.

The cover 27 is distinguished from the cover 25 in that it does not delimit two compartments separated by a deflector 13. The cover 27 exhibits a complementary form of the collector form 23, in such a manner as to define an air collection chamber into which the ends of the assembly of tubes open out.

Moreover, according to the embodiment illustrated in FIGS. 1 to 4, the exchanger 1 comprises two lateral walls 33 to close the core 3.

These walls 33 are, for example, made on the two large lateral sides 3*e*, 3*f* opposite the core 3 (FIG. 3). The walls 33 are therefore opposite lateral surfaces of the stacked tubes of the core 3.

The walls 33 may be fixed to the core 3 by soldering, for example.

According to the example depicted in FIG. 2, the opposite lateral walls 33 are generally rectangular in form, so as to delimit jointly with the end tubes 15*a*, 15*b* an open parallelepiped form to which are connected, for the one part, the inlet 5 and outlet 7 boxes and, on the other hand, the intermediate box 21 for air distribution.

To achieve this, the two walls 33 may exhibit means of fixing 34 on the end tubes 15*a*, 15*b*, respectively.

As mentioned previously, the water inlet 9 and outlet 11 connection pieces allow water to circulate in the core 3.

To achieve this, these inlet 9 and outlet 11 connection pieces are arranged on one of the walls 33. More precisely, in order to allow U-circulation of the water, the two connection pieces 9, 11 are arranged at the level of a first end of a wall 33, being separated one from the other.

The connection pieces 9, 11 are arranged, for example, proximate to the air inlet 5 and outlet 7 boxes.

As can be seen in FIG. 3, the wall 33 may exhibit openings 35 substantially circular in form, for example, for the inlet and outlet, and to the right of this opening 35, a crown 37 oriented towards the outside of the exchanger 1, as illustrated in FIGS. 2 and 3.

This crown 37 is realized by chasing, for example.

The connection pieces 9 and 11 are respectively connected at the level of the openings 35, and the wall 33 extending between the crowns 37 form a sealed separation between the inlet 9 and outlet 11 connection pieces (cf. FIGS. 3 and 5).

Moreover, this separation formed by the wall 33 extending between the two crowns 37 is located substantially opposite lateral surfaces of the two joined tubes 15' and 15" (cf. FIG. 5).

This arrangement allows a substantially U-circulation of the water.

Hence, the second fluid, water in this case, introduced into the core 3 via the outlet 9 connection piece circulates in the second channels interposed between the tubes 15*a*, 15, 15' of the first portion A, then the water circulates in the second channels interposed between the tubes 15", 15, 15*b* before leaving via the outlet 11 connection piece.

Moreover, an intermediate compartment 39 (FIGS. 1 to 4) is provided which communicates both with the second channels of the first portion A and with the second channels of the second portion B of the core 3, in such a manner as to receive water which has circulated in the first portion A, then redistribute it towards the second portion B for removal.

This intermediate compartment 39 therefore participates in the U-circulation of water in the core 3.

The intermediate compartment 39 is arranged on one side of the core 3 perpendicular to the side 3*d* on which the intermediate collector box 21 is arranged.

This particular arrangement allows double U-circulation of the two fluids.

According to the illustrated embodiment, this intermediate compartment 39 is located on the same wall 33 as the inlet 9 and outlet 11 connection pieces, but at the opposite end.

Moreover, in such a manner as to form a water collection chamber, this compartment 39 is presented, for example, in the form of a crown of a wall 33, in a similar manner to the crowns 37, to receive the inlet 9 and outlet 11 connection pieces.

This crown is, for example, realized by chasing.

Moreover, according to the embodiment described, the two fluids circulate in countercurrent. This countercurrent circulation further increases the performance of the heat exchanger 1.

To achieve this, with reference to FIG. 2, the air inlet box 5 is substantially located on the same plane as the water outlet connection piece 11 and the air outlet box 7 is located substantially on the same plane as the water inlet connection piece 9.

Hence, the air inlet box 5 and the outlet connection piece 11 communicate with the second portion B of the core 3, and the air outlet box 7 and the water inlet connection piece 9 communicate with the first portion A of the core 3.

An exchanger 1 of this kind allowing U-circulation both of the first fluid and the second fluid allows the heat exchange surface to be increased by lengthening the circulation route of the two fluids.

Moreover, for the same thermal exchange capacity in relation to an exchanger of the prior art without double U-circulation, a less bulky exchanger 1 is obtained.

The invention claimed is:

1. A heat exchanger for exchanging heat between a first fluid and a second fluid, said heat exchanger comprising:

a heat exchange core for a heat exchange between the first and second fluids, comprising first circulation channels for the first fluid and second circulation channels for the second fluid between said first circulation channels, an inlet collector box for the first fluid and an outlet collector box for the first fluid, into which ends of said first circulation channels open out, and an inlet connection piece for the second fluid and an outlet connection piece for the second fluid, wherein said inlet and outlet collector boxes for the first fluid are fixed on a first side of said heat exchange core and are separated by a deflector, wherein said heat exchanger further comprises an intermediate collector box communicating with said first circulation channels to create a U-circulation of the first fluid in said first circulation channels, wherein said heat exchanger further comprises at least one wall fixed on a second side of said heat exchange core adjacent to said first side and said inlet and outlet connection pieces for the second fluid are disposed at one end of said wall, wherein said inlet connection piece is separated from said outlet connection piece on said wall wherein said heat exchanger further comprises an intermediate compartment communicating with said second circulation channels for a U-circulation of the second fluid in said second circulation channels, and wherein said intermediate collector box and said intermediate compartment are disposed on sides of said heat exchange core, with said side of said heat exchange core having said intermediate collector box perpendicular to said side of said heat exchange core having said intermediate compartment, and wherein said heat exchange core comprises a stack of tubes, of which at least two tubes are joined in such a manner that:

lateral surfaces of said joined tubes are located opposite a junction between said connection pieces, and that said deflector separating said collector boxes is located opposite said junction between said joined tubes.

2. The heat exchanger according to claim 1, further comprising a joint collector box divided by said deflector into two compartments to form said inlet box and said outlet box.

3. The heat exchanger according to claim 2, wherein said intermediate collector box communicating with said first circulation channels is disposed on a third side of said heat exchange core opposite said first side, for the U-circulation of the first fluid.

4. The heat exchanger according to claim 1, wherein said inlet collector box and said outlet collector box of the first fluid are two different parts.

5. The heat exchanger according to claim 4, wherein said intermediate collector box communicating with said first circulation channels is disposed on a third side of said heat exchange core opposite said first side, for the U-circulation of the first fluid.

6. The heat exchanger according to claim 1, wherein said intermediate collector box communicating with said first circulation channels is disposed on a third side of said heat exchange core opposite said first side, for the U-circulation of the first fluid.

7. The heat exchanger according to claim 1, wherein said intermediate compartment communicating with said second circulation channels, for the U-circulation of the second fluid, is disposed on an end of said wall, opposite said connection pieces.

8. The heat exchanger according to claim 1, wherein said heat exchange core has a shape which is parallelepiped with two end sides, two small lateral sides and two large lateral sides, with said two small lateral sides smaller than said two large lateral sides, and in which said first side is a small lateral side and said second side is a large lateral side of said heat exchange core.

9. The heat exchanger according to claim 1, wherein said heat exchanger is configured for the cooling of charge air of a motor vehicle engine.

10. The heat exchanger according to claim 9, wherein the first fluid is charge air and the second fluid is glycol water.

* * * * *